US006013987A

United States Patent [19]

Platt

[11] Patent Number: 6,013,987

[45] Date of Patent: Jan. 11, 2000

[54] MOVING LIGHTS SIMULATOR

[76] Inventor: Jeffrey H. Platt, 22629 Lupine Dr., Torrance, Calif. 90505

[21] Appl. No.: 08/788,390

[22] Filed: Jan. 27, 1997

[51] Int. Cl.[7] ..... H05B 37/00

[52] U.S. Cl. ..... 315/185 R; 315/185 S; 362/806

[58] Field of Search ..... 362/800, 806, 362/812, 227, 233, 234; 250/551, 552; 315/169.1, 169.3, 167, 224, 158, 185 S, 185 R

[56] References Cited

U.S. PATENT DOCUMENTS 4,675,575 6/1987 Smith et al. ..... 315/185 S
4,678,926 7/1987 Davis ..... 307/11
5,575,554 11/1996 Guritz ..... 362/103
5,634,711 6/1997 Kennedy et al. ..... 362/119

*Primary Examiner*—Don Wong
*Assistant Examiner*—David H. Vu
*Attorney, Agent, or Firm*—Swernofsky Law Group

[57] ABSTRACT

The invention provides a method and system for simulating moving lights using nonmoving lights. A row or column of lights, such as LCDs or LEDs, are each controlled by a processor so as to switch each light at a relatively rapid rate, sufficiently rapid so that the light appears on but at only partial brightness. The apparent intensity for each light is controlled by the processor by controlling the duty cycle of each light. This allows the processor to present an illusion of fade-in at a leading edge of a picture element, and to present an illusion of fade-out at a trailing edge of the picture element.

7 Claims, 2 Drawing Sheets

MOVING LIGHTS SIMULATOR

BACKGROUND OF THE INVENTION

1. Field of the Invention

This invention relates to simulating moving lights using nonmoving lights.

2. Related Art

In the art of lighted displays, it is often desired to present a cartoon or picture which gives an impression of motion. When the display itself is stationary (and the lights in the display are themselves stationary), this poses a problem because the impression of motion is necessarily an illusion, and it can be difficult to present an adequate illusion. This problem can be acute where it is desired to give the impression of smooth motion, and particularly when using only a relatively inexpensive display having only a few lights.

One method which is known in the art is to present a sequence of cartoons or pictures, each of which represents a separate still picture in a moving sequence. For example, a moving arrow can be simulated using several still pictures of an arrow. While this method can achieve the illusion of motion, the impression which is given will often be jerky or rough, particularly with a relatively inexpensive display, due to the granular limitation of having only a few lights per foot.

The following patents are examples of the art:

U.S. Pat. No. 3,737,722, "Method And Apparatus For Forming Spatial Light Patterns", issued Jun. 5, 1973, in the name of inventor Meyer J. Scharlack.

U.S. Pat. No. 4,161,018, "Lighted Ornamental Devices", issued Jul. 10, 1979, in the name of inventors James B. Briggs, et al.

U.S. Pat. No. 4,231,079, "Article Of Wearing Apparel", issued Oct. 28, 1980, in the name of inventor Stephen R. Heminover.

U.S. Pat. No. 4,860,177, "Bicycle Safety Light", issued Aug. 22, 1989, in the name of inventors John B. Simms, et al.

U.S. Pat. No. 5,081,568, "Traffic Police Baton With Means To Indicate The Direction In The Night", issued Jan. 14, 1992, in the name of inventors Lu J. Dong, et al.

U.S. Pat. No. 5,327,329, "Lighting Attachments For In-Line Roller or Blade Skates", issued Jul. 5, 1994, in the name of inventor David L. Stiles.

U.S. Pat. No. 5,416,675, "Illuminated Helmet", issued May 16, 1995, in the name of inventor Robert J. DeBeaux.

U.S. Pat. No. 5,438,488, "Illuminated Article of Apparel", issued Aug. 1, 1995, in the name of inventor Larry Dion, and assigned to LaMi Products, Inc.

U.S. Pat. No. 5,457,612, "Bicycle Rear Lighting System", issued Oct. 10, 1995, in the name of inventor Scot Carter.

U.S. Pat. No. 5,544,027, "LED Display For Protective Helmet And Helmet Containing Same", issued Aug. 6, 1996, in the name of inventor Anthony Orsano.

Accordingly, it would be desirable to provide a method and system for providing an illusion of relatively smooth motion in a lighted display, with only a relatively rough granularity and only a relatively small number of lights. This advantage is achieved in an embodiment of the invention in which much smaller degrees of motion are simulated by simulating lights which appear to be partly on and partly off.

SUMMARY OF THE INVENTION

The invention provides a method and system for simulating moving lights using nonmoving lights. A row or column of lights, such as LCDs or LEDs, are each controlled by a processor so as to switch each light at a relatively rapid rate, sufficiently rapid so that the light appears on but at only partial brightness. The apparent intensity for each light is controlled by the processor by controlling the duty cycle of each light. This allows the processor to present an illusion of fade-in at a leading edge of a picture element, and to present an illusion of fade-out at a trailing edge of the picture element.

DETAILED DESCRIPTION OF THE PREFERRED EMBODIMENT

In the following description, a preferred embodiment of the invention is described with regard to preferred process steps and data structures. Those skilled in the art would recognize after perusal of this application that embodiments of the invention can be implemented using one or more general purpose processors operating under program control, or special purpose processors adapted to particular process steps and data structures, and that implementation of the process steps and data structures described herein would not require undue experimentation or further invention.

Figure 1:
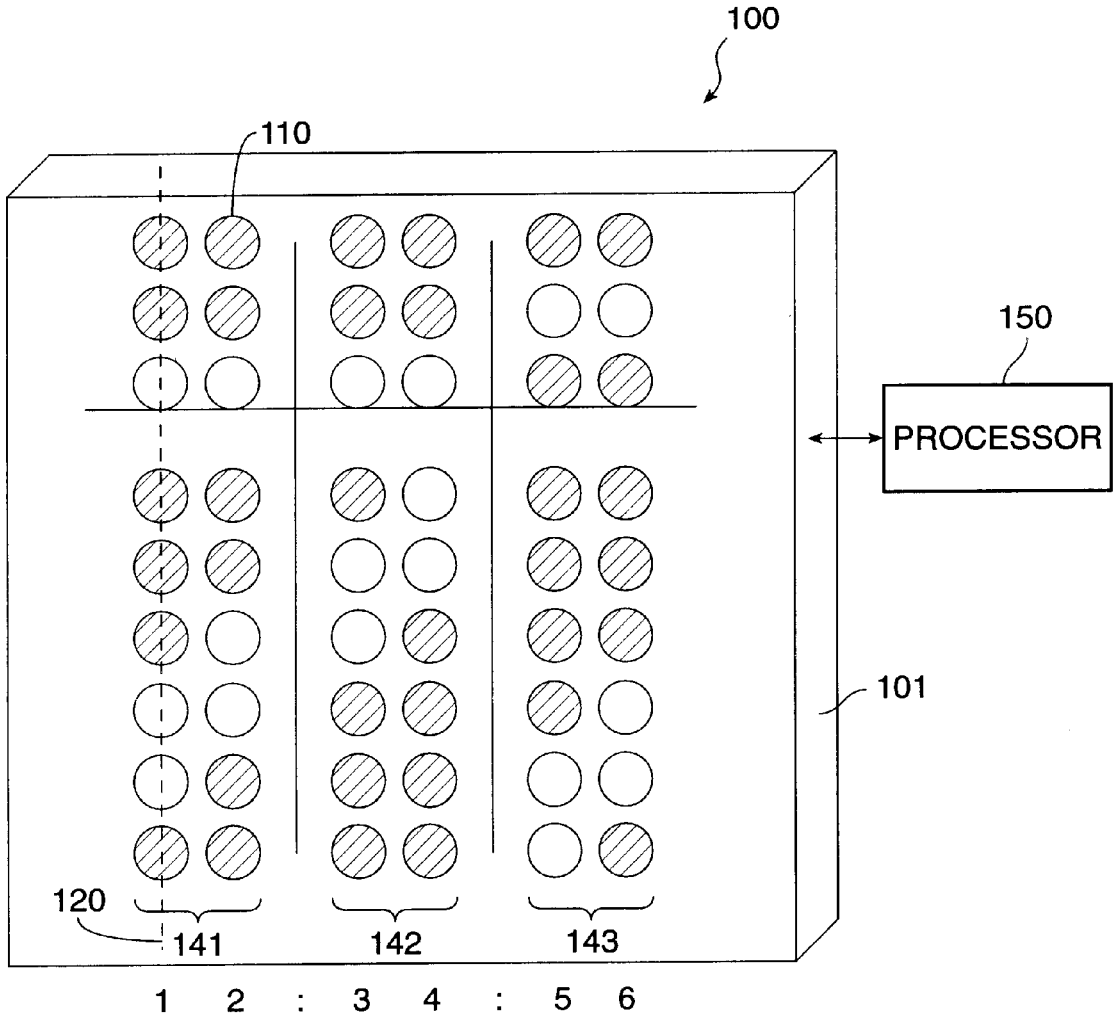
FIG. 1 shows a block diagram of a system for simulating moving lights.

FIG. 1 shows a block diagram of a system for simulating moving lights.

A system 100 includes a base 101 and a plurality of light elements 110, each of which is affixed to the base 101 and is fixed relative to the system 100 itself. The light elements 110 are disposed in at least one line 120, such as a sequence of rows or columns.

In a preferred embodiment, the light elements 110 are light-emitting diodes (LEDs), but in alternative embodiments, the light elements 110 may be liquid crystal diodes which are backlit and which pass, block, or reflect illumination, or may be incandescent or flourescent lights. As described herein, the invention is not limited to any particular type of light element, so long as the light can be controlled as described herein.

In a preferred embodiment, the light elements 110 are disposed in a plurality of lines 120, each of which comprises a column in a form representing a clock in the shape of an abacus. The abacus includes one line 120 forming a column for each digit of a clock display, thus preferably including two columns for an hourly value 141, two columns for a minutes value 142, and two columns for a seconds value 143. Each column includes at least one light element 110 for each of a set of four "ones" beads, plus at least two light elements 110 representing spaces for "ones" beads to be moved to, and at least one light element 110 for a "fives" bead, plus at least two light elements 110 representing spaces for the "fives" bead to be moved to.

Each light element 110 is independently coupled to a processor 150, which operates under software control to turn each light element 110 on and off. However, in an alternative embodiment, the processor 150 may be replaced with circuits whose special purpose is to control each light element 110 as described herein with regard to control by the processor 150.

Power (not shown) is independently supplied to each light element 110 and provides for each light element 110 to emit light (or reflect or transmit light, as appropriate) as controlled by the processor 150.

Figure 2:
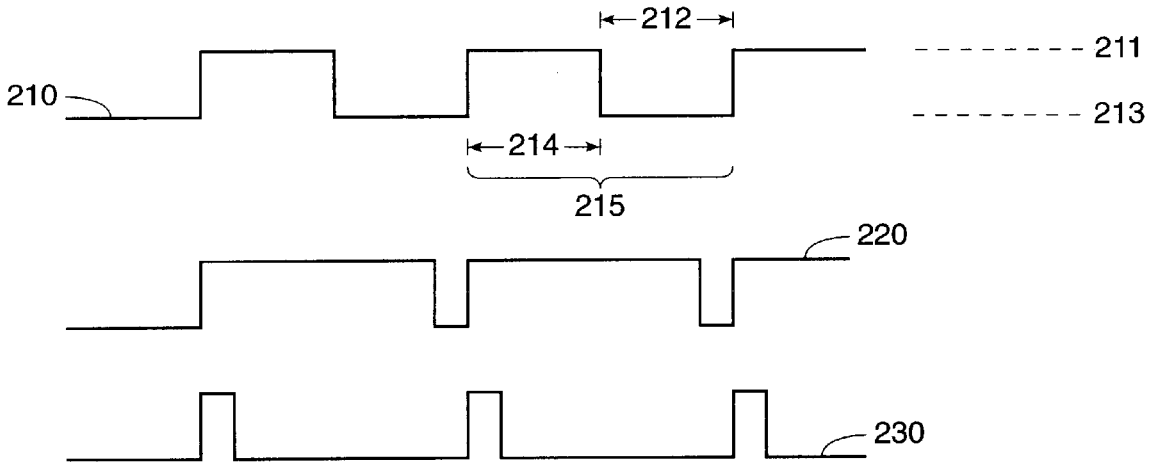
FIG. 2 shows a timing diagram of a set of waveforms in the system.

FIG. 2 shows a timing diagram of a set of waveforms in the system.

A first waveform 210 represents a light in a partially "on" state. The first waveform 210 is a periodic waveform, such as a square wave, having a light-on voltage 211 representing a light-on state 214 and a light-off voltage 213 representing a light-off state 212. For example, the light-on voltage 211 can be +5.0 volts relative to ground and the light-off voltage 213 can be +0.0 volts relative to ground.

The first waveform 210 has a frequency which is high enough that the human eye is unable to distinguish individual transitions of the first waveform 210 between the light-on state 214 and the light-off state 212, and has a period 215 which is the inverse of its frequency. For example, in a preferred embodiment, the frequency of the first waveform 210 can be about 50 times per second, so the period 215 of the first waveform 210 is thus about 20 milliseconds.

Each period 215 includes one light-on state 214 and one light-off state 212. Within each period 215 the light-on state 214 is a selected fraction of the total period 215, called herein the "duty cycle" of the first waveform 210. For example, if the light-on state 214 is half the total period 215 (so that the light is therefore "on" half of each period 215), the duty cycle of the first waveform 210 is ½ or 50%.

A second waveform 220 represents a light in a substantially fully "on" state. It is identical to the first waveform 210 except that it has a duty cycle of about 95%.

A third waveform 230 represents a light in a substantially fully "off" state. It is identical to the first waveform 210 except that it has a duty cycle of about 5%.

Figure 3:
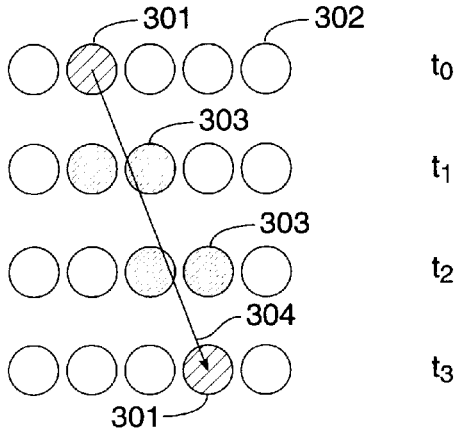
FIG. 3 shows a display using nonmoving light elements to simulate a moving light.

FIG. 3 shows a display using nonmoving light elements to simulate a moving light.

A set of light elements 110 in a line 120 at a first time includes a primary "on" light 301, comprising a light element 110 in a substantially fully on state having a duty cycle near 100%, and a set of "off" lights 302, comprising light elements in substantially fully off states having duty cycles near 0%.

The processor 150 generates the primary light 301 by controlling the duty cycle of the selected light element 110. The processor 150 also controls the duty cycle of all other light elements 110, and so effectively generates the "off" lights 302 as well.

The processor 150 can control the duty cycles of the selected light elements 110 directly, such as by transmitting a (separate) waveform for turning each light element 110 on and off directly thereto. The processor can also control the duty cycles of the selected light elements 110 indirectly, such as by transmitting a numeric value to a counter or other controller, which generates and transmits the (separate) waveform for turning each light element 110 on and off directly to the light element 110 itself. In the second case, the counter preferably includes a 7497 rate multiplier chip. In either case, the processor 150 has control over whether each light element 110 is fully on, fully off, or partially on.

The human eye integrates the amount of light it receives from any given point using a relatively long time constant. The apparent intensity of any light element 110 depends on the duty cycle which is assigned to that light element 110, so any light element can be made to appear bright, such as by controlling it to have a duty cycle near 100%, to appear dim, such as by controlling it to have a duty cycle near 0%, or to appear to have any selected degree of partial brightness, such as by controlling it to have a selected duty cycle corresponding to that selected degree of partial brightness.

To simulate a moving light, at a set time, the processor 150 gradually alters the duty cycle of the primary light 301 and the "off" lights 302 in a sequence of steps. In this example, the simulated moving light moves rightward in the figure, but there is no particular requirement that the moving Light must move rightward; it can also move leftward, or up or down if the line 120 of light elements 110 permits.

At a time t0, the primary light 301 is fully on and the "off" lights 302 are fully off. The processor 150 gradually alters the duty cycle of the primary light 301 and selected other light elements 110 to achieve the status shown for the time t1.

At a time t1, the light element 110 for the primary light 301 is only partially on and appears dimmer than did the primary light 301, while the light element 110 to the right of the primary light 301 is also partially on. The two selected light elements comprise secondary lights 303; the total light emitted by the two secondary lights 303 is equal to that originally emitted by the primary light 301. The processor 150 gradually alters the duty cycle of the secondary lights 303 and selected other light elements 110 to achieve the status shown for the time t2.

At a time t2, the light element 110 for the leftmost secondary light 303 is substantially fully off and appears off, while the light element 110 to the right of the rightmost secondary light is partially on. The two secondary lights 303 thus appear to have moved to the right, but the total light emitted by the two secondary lights 303 is still equal to that originally emitted by the primary light 301. The processor 150 gradually alters the duty cycle of the secondary lights 303 and selected other light elements 110 to achieve the status shown for the time t3.

At a time t3, the light element 110 for the leftmost secondary light 303 is substantially fully off and appears off, while the light element 110 for the rightmost secondary light 303 is substantially fully on and now comprises a primary light 301. Thus, the primary light 301 appears to have moved to the right along the path 304.

Other and further patterns of primary lights 301 and secondary lights 302 can be used to present the illusion of moving lights. In one alternative process, the following steps occur: The "off" light 302 directly to the right of the primary light 301 is gradually increased in duty cycle from 0% to 100% (thus becoming a secondary light 303) as the primary light 301 is gradually decreased in duty cycle from 100% to 0% (thus also becoming a secondary light 303). When any secondary light 303 increases to 40% duty cycle, the next light element 110 is also gradually increased from 0% to 100%, and so on. When any secondary light 303 decreases to 60% duty cycle, the next light element 110 decreases is also gradually decreased from 100% to 0%, and so on.

The processor 150 can gradually alter the duty cycles of selected light elements 110 by changing the duty cycles of those light elements 110 by a small amount for a small amount of time, then again altering those duty cycles by another small amount for another small amount of time, and so on until the transition is complete. In a preferred embodiment, the small amount of duty cycle is about 20% and the small amount of time is about 100 milliseconds.

During the transition time it thus occurs that the processor 150 causes the "next" light element 110 to become gradually brighter, while causing the "last" light element 110 to become gradually dimmer.

Alternative Embodiments

Although preferred embodiments are disclosed herein, many variations are possible which remain within the concept, scope, and spirit of the invention, and these variations would become clear to those skilled in the art after perusal of this application.

For example, the invention is equally applicable to moving lights showing picture elements in two dimensions as well as one dimension, thus moving in an array of light elements and possibly not along lines defined by the the array.

I claim:

1. A method for simulating a moving light, including the steps of:

disposing a plurality of adjacent nonmoving lights in a line;

controlling with a processor operating under software control the apparent intensity of said adjacent nonmoving lights by substantially continuously varying the duty cycle of said adjacent nonmoving lights at a controllable duty cycle such that at least two of said plurality of adjacent nonmoving lights are on simultaneously, said controllable duty cycle being sufficiently rapid so that said adjacent nonmoving lights appear to have variable brightness, whereby a collective light emission which includes more than one of said plurality of nonmoving lights is presented and appears to move.

2. A method as in claim 1, wherein said collective light emission includes a picture element, and at least one nonmoving light at an edge of said picture element having a partial brightness, to create an illusion of fade-in or fade-out of said picture element.

3. A system for simulating moving lights, including:

a plurality of adjacent nonmoving lights;

a processor operating under software control and coupled to said plurality of nonmoving lights, said processor controlling the apparent intensity of said adjacent nonmoving lights by substantially continuously varying the duty cycle of said adjacent nonmoving lights at a controllable duty cycle such that at least two of said plurality of adjacent nonmoving lights are on simultaneously, said nonmoving lights appear to have variable brightness whereby a collective light emission which includes more than one of said plurality of nonmoving lights is presented and appears to move.

4. A system as in claim 3, wherein at least one of said lights includes a light emitting diode.

5. A system as in claim 3, wherein at least one of said lights includes a liquid crystal diode.

6. A system as in claim 3, wherein said plurality of nonmoving lights includes a row or column of said nonmoving lights.

7. A system as in claim 3, wherein said processor when operating is capable of altering said controllable duty cycle to present a picture element, an illusion of fade-in at a leading edge of said picture element, and to present an illusion of fade-out at a trailing edge of said picture element.

* * * * *